US008837961B2

(12) United States Patent
Kawajiri

(10) Patent No.: US 8,837,961 B2
(45) Date of Patent: Sep. 16, 2014

(54) IMAGE FORMING APPARATUS, METHOD FOR CONTROLLING SAME, AND STORAGE MEDIUM FOR SAME

(75) Inventor: Kensuke Kawajiri, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 602 days.

(21) Appl. No.: 13/152,570

(22) Filed: Jun. 3, 2011

(65) Prior Publication Data

US 2011/0305466 A1 Dec. 15, 2011

(30) Foreign Application Priority Data

Jun. 15, 2010 (JP) ..... 2010-135734

(51) Int. Cl.

| | |
|---|---|
| ***G03G 15/08*** | (2006.01) |
| ***G03G 15/00*** | (2006.01) |
| ***G03G 15/01*** | (2006.01) |
| ***G03G 21/16*** | (2006.01) |

(52) U.S. Cl.

CPC ..... *G03G 21/1676* (2013.01); *G03G 15/502* (2013.01); *G03G 2215/00109* (2013.01); *G03G 2215/0177* (2013.01)

USPC ..... 399/27; 399/13; 399/227

(58) Field of Classification Search

CPC ..... G03G 2215/0177; G03G 15/553

USPC ..... 399/13, 24, 227, 25–27

See application file for complete search history.

(56) References Cited

U.S. PATENT DOCUMENTS

| | | | |
|---|---|---|---|
| 7,010,243 | B2 | 3/2006 | Shimada |
| 2008/0124093 | A1 | 5/2008 | Kai |

FOREIGN PATENT DOCUMENTS

| | | | |
|---|---|---|---|
| CN | 101206441 | A | 6/2008 |
| JP | 2003-323027 | A | 11/2003 |
| JP | 2004-133012 | A | 4/2004 |
| JP | 2004-333730 | A | 11/2004 |
| JP | 20040333726 | A | 11/2004 |
| JP | 2008-15947 | A | 1/2008 |

OTHER PUBLICATIONS

Machine translation of JP2004-133012.*

Chinese Office Action dated Jun. 20, 2013, in related Chinese Patent Application No. 201110166029.3 (with English translation).

* cited by examiner

*Primary Examiner* — David Gray

*Assistant Examiner* — Andrew V Do

(74) *Attorney, Agent, or Firm* — Fitzpatrick, Cella, Harper & Scinto

(57) ABSTRACT

An image forming apparatus rotationally moves a plurality of recording material storage units that store a recording material and includes a moving unit configured to move the recording material storage unit to a replacement position, and a detection unit configured to detect an in-motion status in which the recording material storage unit is moving to the replacement position. In addition, a determination unit determines either a first state or a second state of the image forming apparatus as the state of the image forming apparatus that is to replace the in-motion status and should be reported to a user when the detection unit detects the in-motion status should not be reported to a user. The first state is a state which is currently being reported to the user when it is detected that the recording material storage unit is in the in-motion status, and the second state is a state which transitions after the recording material storage unit moves to the replacement position, and the second state is a printing state in which the image forming apparatus is in printing.

7 Claims, 7 Drawing Sheets

FIG. 7

| State upon rotation detection | Transition state after rotation | Report state |
|---|---|---|
| Printing | No toner | Printing |
| Preparing | Different toner color | Preparing |
| Preparing | No toner cartridge | Preparing |
| Ready | Printing | Printing |

IMAGE FORMING APPARATUS, METHOD FOR CONTROLLING SAME, AND STORAGE MEDIUM FOR SAME

BACKGROUND OF THE INVENTION

1. Field of the Invention

The present invention relates to an image forming apparatus, a method for controlling the same, and a storage medium for the same.

2. Description of the Related Art

A rotation developing rotary-type image forming apparatus that rotationally moves a plurality of toner cartridges serving as recording material storage units to perform printing has been proposed. For example, there is a color printing apparatus that moves a toner cartridge having therein a color toner desired by a user to the replacement position depending on the specification by a user operation input or the status of the image forming apparatus, such as "no toner" or the like. During a time period when the color printing apparatus moves the toner cartridge to the replacement position, a message (in-motion message) for reporting to a user the fact that the toner cartridge is moving to the replacement position is displayed on a display unit. The replacement position is a position at which the toner cartridge can be replaced.

Japanese Patent Laid-Open No. 2003-323027 discloses an apparatus that detects the respective amounts of toner accommodated in the toner cartridges and moves a toner cartridge, of which the detected amount of toner is the smallest, to the replacement position. Also, Japanese Patent Laid-Open No. 2008-15947 discloses a data processing apparatus that determines the usefulness of a warning display based on the state of a print job so that a warning display of low usefulness is not performed.

If an in-motion message is always displayed on a display unit while the rotation developing rotary-type color printing apparatus moves a toner cartridge to the replacement position, the following problems may occur depending on the display timing. More specifically, when the color printing apparatus automatically moves a toner cartridge to the replacement position depending on the "no toner" status or the like regardless of a user operation input, an in-motion message may be displayed despite the fact that a user does not perform a toner cartridge replacement operation. Consequently, a user cannot understand why the color printing apparatus moves a toner cartridge to the replacement position, resulting in possible confusion of the user. Furthermore, even when the technology disclosed in Japanese Patent Laid-Open No. 2008-15947 is applied to the color printing apparatus such that the propriety of a warning display is determined based on the state of a print job, an appropriate message which is an alternative for an in-motion message cannot be selected as an alternative display and thus cannot be reported to a user.

SUMMARY OF THE INVENTION

The present invention provides a framework that determines an appropriate state for substituting the in-motion status, when a recording material storage unit is in the status of moving to the replacement position and the in-motion status should not be reported to a user.

According to an aspect of the present invention, an image forming apparatus that rotationally moves a plurality of recording material storage units that store a recording material to thereby perform printing is provided that includes a moving unit configured to move the recording material storage unit to a replacement position; a detection unit configured to detect an in-motion status in which the recording material storage unit is moving to the replacement position; an acquisition unit configured to acquire a state of the image forming apparatus, which is currently being reported to a user, as a first state and acquire a state of the image forming apparatus, which transitions after the recording material storage unit moves to the replacement position, as a second state when it is detected that the recording material storage unit is in the in-motion status; and a determination unit configured to determine either the first state or the second state as the state of the image forming apparatus that is to replace the in-motion status and should be reported to a user when it is determined that the detected in-motion status should not be reported to a user.

The image forming apparatus of the present invention does not report the in-motion status to a user when the fact that a toner cartridge is moving to the replacement position should not be reported to a user. Then, the image forming apparatus of the present invention displays the state of an image forming apparatus that is suitable for substitution. Therefore, for example, when the image forming apparatus automatically moves the toner cartridge to the replacement position regardless of a user operation input, the state of the image forming apparatus can be displayed such that a user will not be confused thereby.

Further features of the present invention will become apparent from the following description of exemplary embodiments with reference to the attached drawings.

BRIEF DESCRIPTION OF THE DRAWINGS

FIG. 7 is a diagram illustrating an example of an alternative state table.

DESCRIPTION OF THE EMBODIMENTS

Figure 1A:
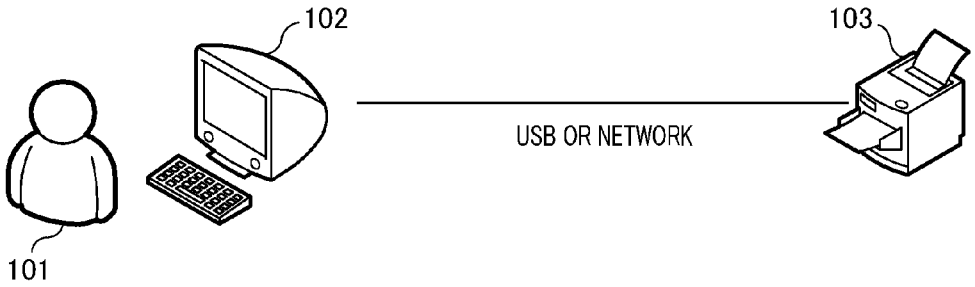
FIG. 1A is a diagram illustrating an example of the system configuration of the present embodiment.
Figure 1B:
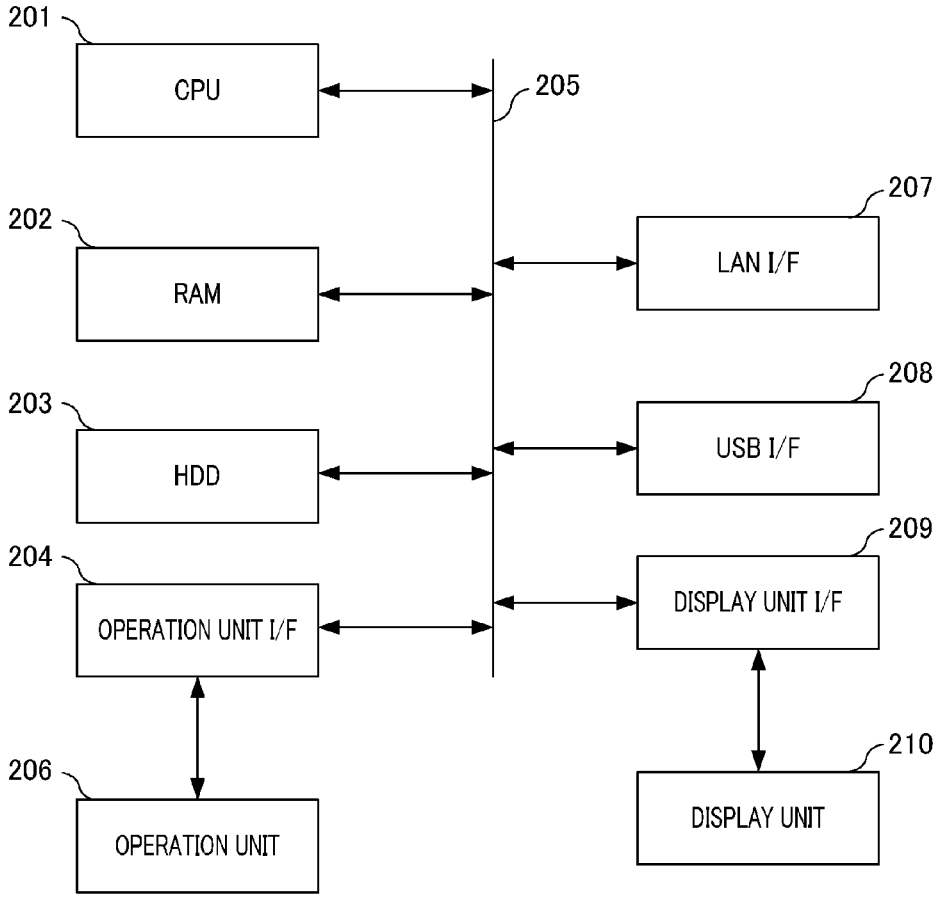
FIG. 1B is a diagram illustrating an example of the hardware configuration of a PC.

FIGS. 1A and 1B are diagrams illustrating an example of the system configuration of the present embodiment and an example of the hardware configuration of a PC, respectively. FIG. 1A is a diagram illustrating an example of the system configuration of the present embodiment. The system shown in FIG. 1A includes a PC (Personal Computer) 102 and a device 103. The PC 102 and the device 103 are connected to each other via a communication cable (e.g., USB or the like) or a network, where USB is an abbreviation for Universal Serial Bus. The PC 102 is an information processing apparatus that is operated by a user 101. The user 101 can employ a UI (User Interface) application that operates on the PC 102 to thereby provide any setting or instruction to the device 103. The UI application displays the status (state) of the device 103 on a display unit provided in the PC 102. With this arrangement, the status of the device 103 is reported to a user of the PC 102. More specifically, notification of the status of the device 103 is carried out by being displayed on a display unit of an external device that communicates via a network. The device 103 is the image forming apparatus of the present embodiment. The device 103 rotationally moves a plurality of recording material storage units (toner cartridges) that store toner serving as a recording material to thereby perform a printing. The device 103 is, for example, a color printing apparatus. The device 103 of the present embodiment does not have an operation panel, or alternatively, has an extremely small operation panel.

FIG. 1B is a diagram illustrating an example of the hardware configuration of the PC 102 shown in FIG. 1A. The PC 102 includes a CPU (Central Processing Unit) 201, a RAM (Random Access Memory) 202. The PC 102 also includes a HDD (Hard Disk Drive) 203, an operation unit I/F (Interface) 204, and an operation unit 206. The PC 102 further includes a LAN (Local Area Network) I/F 207, a USB I/F 208, a display unit I/F 209, and a display unit 210. The respective devices provided in the PC 102 are arranged on a system bus 205.

The CPU 201 is a processor that controls the overall PC 102. The RAM 202 is a system working memory where the CPU 201 operates. The RAM 202 is employed as a program memory for recording a program. The HDD 203 is a data storage region. The operation unit I/F 204 is an interface unit that mediates an input/output of information to/from the operation unit 206. The operation unit I/F 204 receives an input signal from the operation unit 206. Also, the operation unit I/F 204 conveys information input by a user to the CPU 201 via the operation unit 206. The display unit I/F 209 is an interface unit that mediates an input/output of information to/from the display unit 210. The display unit I/F 209 outputs an output signal to the display unit 210 in accordance with the control by the CPU 201. The USB I/F 208 is a functional unit for connecting to a USB device. The USB I/F 208 is employed for acquiring or returning the status of another device via a USB. The LAN I/F 207 is a functional unit for connecting to LAN. The LAN I/F 207 is employed for acquiring or returning the status of another device via LAN.

Figure 2:
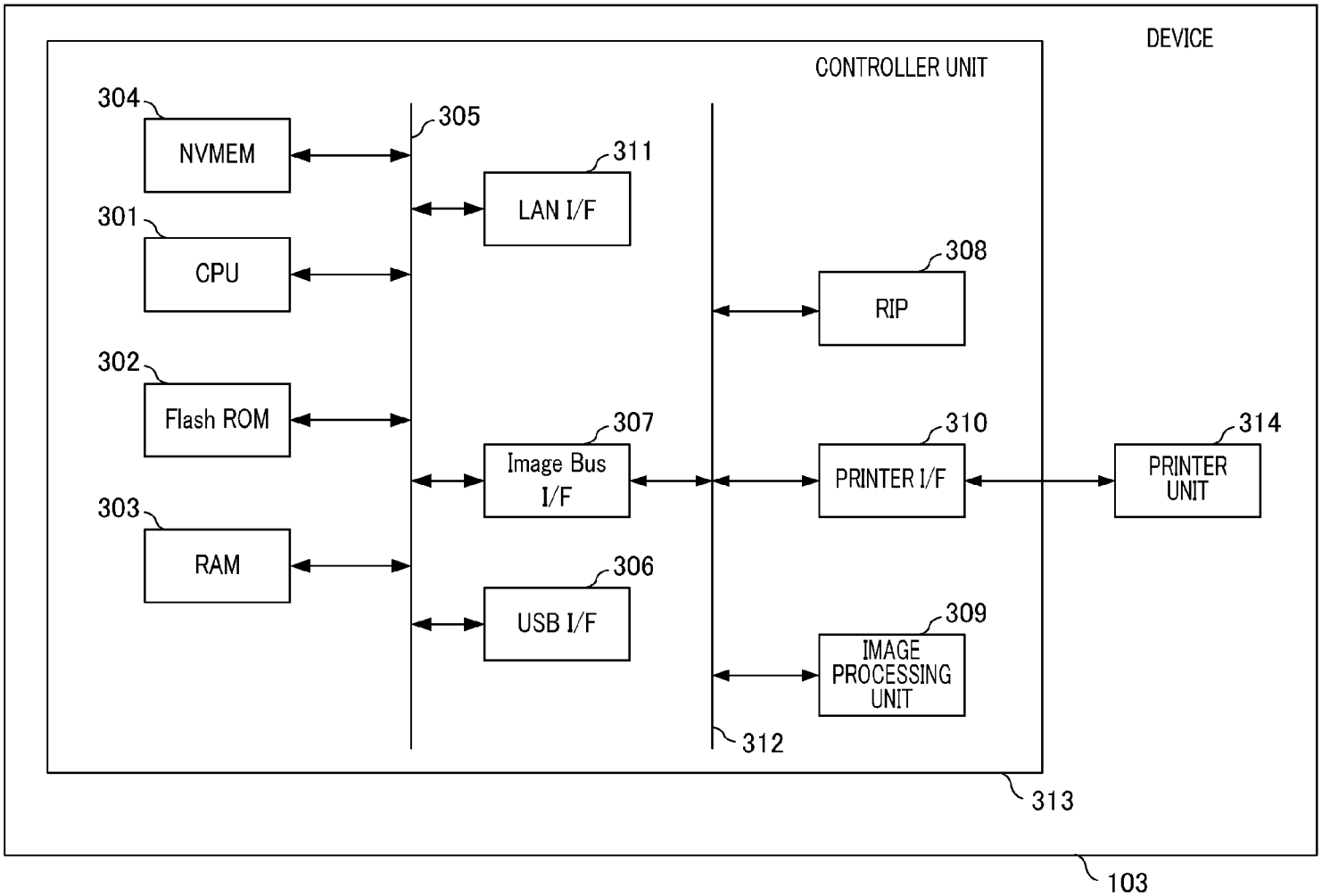
FIG. 2 is a diagram illustrating an example of the hardware configuration of a device.

FIG. 2 is a diagram illustrating an example of the hardware configuration of the device 103 shown in FIG. 1A. The device 103 includes a controller unit 313 and a printer unit 314. The controller unit 313 controls the overall device 103. More specifically, a method for controlling the image forming apparatus of the present embodiment and a storage medium for the same can be realized by the functions of the controller unit 313. The controller unit 313 provides an instruction to the printer unit 314, and causes it to execute image data print processing. Also, the controller unit 313 receives a replacement position movement instruction in response to a user operation input from a UI application on the PC 102, and provides a replacement position movement instruction to the printer unit 314. The replacement position movement instruction is an instruction for moving the specified toner cartridge to the replacement position.

Also, the controller unit 313 acquires the state of the device 103 from the printer unit 314. The controller unit 313 automatically provides a replacement position movement instruction to the printer unit 314 depending on the state of the acquired device 103. For example, when the black toner cartridge is not positioned at the replacement position, the controller unit 313 provides a replacement position movement instruction. Also, for example, the controller unit 313 automatically provides a replacement position movement instruction to the printer unit 314 based on error information. Error information is information indicating the state relating to an error occurring in toner cartridge. Error information includes, for example, no toner cartridge, no toner, and the like.

Also, the controller unit 313 functions as a detection unit configured to detect that the toner cartridge is in the state (in-motion status) in which the toner cartridge is rotationally moving to the replacement position through the acquisition of the state of the device 103 from the printer unit 314. The controller unit 313 is an acquisition unit configured to acquire the state of the device 103, which is currently being displayed on a display unit provided in the PC 102, that is, is currently being reported to a user, as a first state when it is detected that the toner cartridge is in the in-motion status. The controller unit 313 acquires the state of the device 103, which transits after the toner cartridge moves to the replacement position, as a second state. For example, the controller unit 313 acquires error information as information indicating the second state from the printer unit 314.

The controller unit 313 determines whether or not the detected in-motion status should be a subject to be displayed, that is, should be reported to a user based on the first state and the second state that have been acquired. When the controller unit 313 determines that the in-motion status should not be reported to a user, the controller unit 313 functions as a determination unit configured to determine either the first state or the second state as the state of the device 103 that is to replace the in-motion status and should be reported to a user. According to an embodiment of the present invention, when the in-motion status is not the state corresponding to the movement of the toner cartridge in response to the user operation input and the controller unit 313 determines that the in-motion status should not be reported to a user, the controller unit 313 executes the following processing. The controller unit 313 determines the state of the device 103 that is to replace the in-motion status and should be reported to a user based on the first state and the second state.

The printer unit 314 executes print processing in accordance with the instruction given by the controller unit 313. Also, the printer unit 314 acquires the state of the device 103 and transmits it to the controller unit 313. Furthermore, the printer unit 314 receives a replacement position movement instruction from the controller unit 313, and rotationally moves the toner cartridge to be moved to the replacement position. More specifically, each of the controller unit 313 and the printer unit 314 functions as a moving unit configured to move the toner cartridge to the replacement position.

The controller unit 313 includes a CPU 301, a Flash ROM (Read Only Memory) 302, and a RAM (Random Access Memory) 303. The controller unit 313 also includes an NVMEM (Non-Volatile Memory) 304, a LAN I/F 305, an Image Bus I/F 307, and an USB I/F 306. The controller unit 313 further includes a RIP (Raster Image Processor) 308, a printer I/F 310, and an image processing unit 309.

The CPU 301 is a processor that controls the controller unit 313 overall. The RAM 303 is a system working memory where the CPU 301 operates. The RAM 303 is a program memory for recording a program or an image memory for temporarily recording image data. The NVMEM 304 is a non-volatile memory that records setting information or the like. The Flash ROM 302 is a rewritable non-volatile memory. The Flash ROM 302 stores various control programs for controlling the device 103 in advance. The USB I/F 307 enables the PC 102 to connect to USB devices. The LAN I/F 305 enables the PC 102 to connect to LAN. The image bus I/F 307 is a bus bridge that connects a system bus 305 to an image bus 312 that transfers image data at high speed to thereby convert data structure. The components from the CPU 301 to the USB I/F 306 are arranged on the system bus 305.

The image bus 312 includes a PCI (Peripheral Component Interconnect) bus or an IEEE 1394. The RIP 308, the printer I/F 310, and the image processing unit 309 are arranged on the image bus 312. The RIP 308 expands vector data such as a PDL (Page Description Language) code to bitmap image data (raster image data). The printer I/F 310 connects the printer unit 314 to the controller unit 313 to thereby perform synchronous/asynchronous conversion of image data and exchange of data. The image processing unit 309 performs correcting, modifying, editing for input image data, and performs printer correction, resolution conversion, and the like for print output image data. Also, the image processing unit 309 performs image data rotation or performs compression/decompression processing such as JPEG for multilevel-image data and such as JBIG, MMR, MH, or the like for binary image data.

The printer unit 314 converts the raster image data that has been produced by the RIP 308 into an image on a paper sheet. Methods for converting raster image data into an image on a paper sheet by the printer unit 314 include an electro-photographic system that employs a photosensitive drum or a photosensitive belt, an ink jet system that ejects ink from a fine nozzle array to thereby print an image directly onto a paper sheet, and the like. The printer unit 314 may use any one of these systems. The printer unit 314 starts activation of a print operation in accordance with the instruction given by the CPU 301.

Figure 3A:
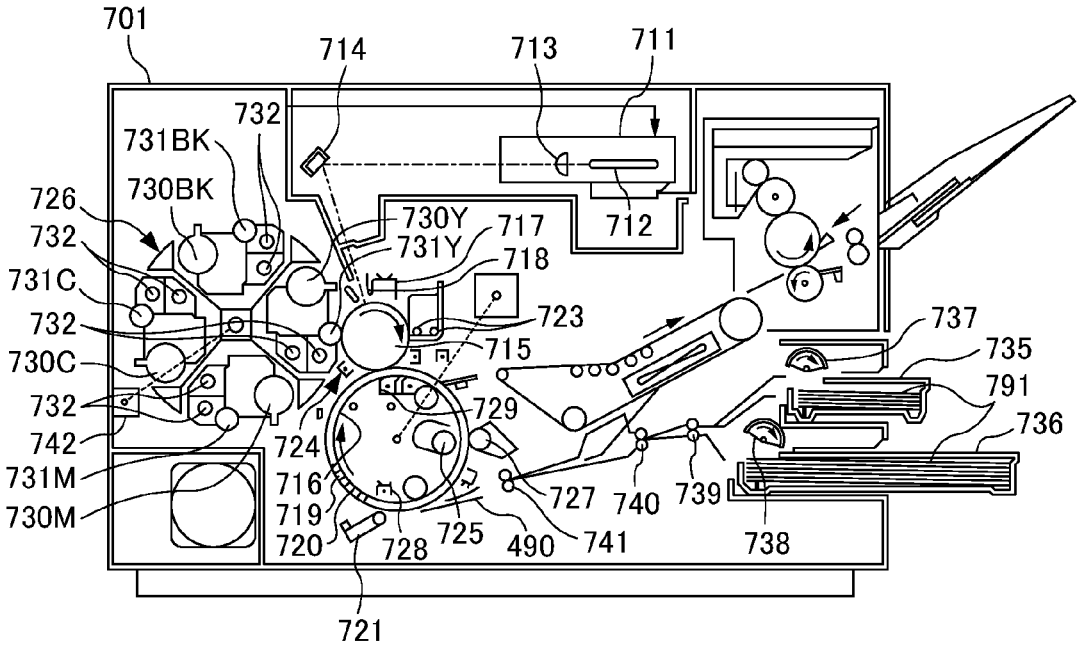
FIG. 3A is a cross-sectional diagram illustrating an example of a device.
Figure 3B:
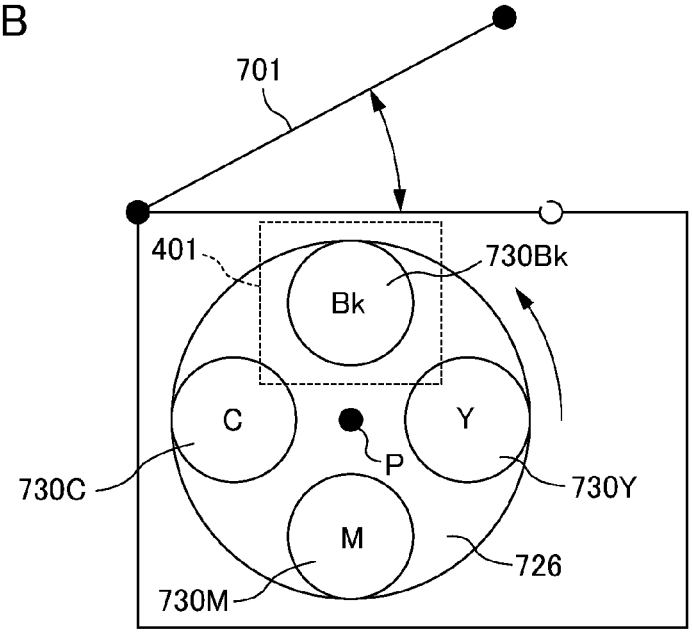
FIG. 3B is a diagram illustrating a framework for replacing a toner cartridge provided in a device.

FIGS. 3A and 3B are cross-sectional diagrams illustrating an example of a device shown in FIG. 1A and a diagram illustrating a framework for replacing a toner cartridge provided in the device, respectively. FIG. 3A is a cross-sectional diagram illustrating an example of the device 103. The device 103 shown in FIG. 3A is a color printing apparatus employing a rotation developing system. A scanner 711 provided in the device 103 includes a laser output unit that converts an image signal into an optical signal, a polygonal (e.g., octahedral) polygon mirror 712, a motor that rotates the polygon mirror 712, and an f/θ lens (imaging lens) 713.

The laser beam emitted from the laser output unit is reflected by the side surface of the polygon mirror 712, passes through the f/θ lens 713 and a reflection mirror 714, and scans line by line (raster scan) the surface of a photosensitive drum 715 that rotates in the direction of the illustrated arrow. With this arrangement, an electrostatic latent image corresponding to an image of an original document is formed on the surface of the photosensitive drum 715. A primary charger 717, an entire surface exposure lamp 718, a cleaner unit 723 that collects residual toner not transferred to the paper sheet, and a pre-transferring charger 724 are arranged at the periphery of the photosensitive drum 715.

A developing unit 726 is a unit that develops an electrostatic latent image, which has been formed onto the surface of the photosensitive drum 715, by laser exposure. The developing unit 726 has the configuration to be described below. More specifically, the development sleeves (731Y, 731M, 731C, 731Bk) provided in the developing unit 726 are brought into contact with the photosensitive drum 715 for direct development. Each of the toner cartridges (730Y, 730M, 730C, 730Bk) stores a reserve toner. A screw 732 transports a developing agent. The development sleeves (731Y, 731M, 731C, 731Bk), the toner cartridges (730Y, 730M, 730C, 730Bk), and the screw (732) are disposed around the central shaft P of the developing unit (726). Note that the reference symbols "Y", "M", "C", and "Bk" of the respective components described above indicate the colors thereof, where "Y" refers to yellow, "M" refers to magenta, "C" refers to cyan, and "Bk" refers to black.

A main body cover 701 is the cover that covers the main body of the device 103. The main body cover 701 is configured such that the user 101 can open and close the main body cover 701. The user 101 can remove only the toner cartridge (730Y, 730M, 730C, or 730Bk) that is located directly under the main body cover 701. The location directly under the main body cover 701 is referred to as the "replacement position". More specifically, among a plurality of toner cartridges, only the one toner cartridge located at the replacement position is replaceable. In the example shown in FIG. 3A, the black toner cartridge (730Bk) is arranged at the replacement position. The toner color located at the replacement position can be changed by rotating the toner cartridges (730Y, 730M, 730C, 730Bk) about the shaft P. Also, the device 103 is intended to perform printing at the fastest speed when the black toner cartridge (730Bk) is arranged at the replacement position. When the device 103 is able to perform printing at the fastest speed, the toner color that is present at the replacement position may vary depending on the engine configuration.

A developing unit position sensor 742 detects the rotation position of the developing unit 726. When the yellow toner image is formed, the developing unit 726 performs yellow toner development processing at the position shown in FIG. 3A. When the magenta toner image is formed, the developing unit 726 rotates about the shaft P such that the development sleeve (731M) in the magenta developer is brought into contact with the photosensitive drum 715. When the cyan and the black toner image are developed, the developing unit 726 operates in the same manner. A transfer drum 716 transfers a toner image formed onto the photosensitive drum 715 to a paper sheet. An actuator plate 719 detects the moving position of the transfer drum 716. A position sensor 720 is brought into close contact with the actuator plate 719 to thereby detect the fact that the transfer drum 716 has moved to the home position.

The actuator plate 719, the position sensor 720, a transfer drum cleaner 725, a paper retaining roller 727, and a neutralizer 729 are transfer chargers that are disposed around a transfer roller 716. On the other hand, each of paper-feeding cassettes (735 and 736) accommodates a paper sheet (paper leaf body) 791. For example, it is assumed that A4-sized paper sheets are accommodated in the paper-feeding cassette 735 and A3-sized paper sheets are accommodated in the paper-feeding cassette 736. When a paper sheet is fed and transferred, a paper sheet is fed from the cassette (735, 736) by the paper feeding roller (737, 738). Timing rollers (739, 740, and 741) determine the timing of paper feeding and paper transferring. A paper sheet passes through these rollers and is guided into a paper guide 490. Then, a front edge of the paper sheet is gripped by a gripper 728, and the paper sheet is wrapped around the transfer drum 716. With this arrangement, the operation of the device 103 proceeds to an image forming process. By having the aforementioned configuration, the device 103 can realize full color printing corresponding to four colors, i.e., YMCK.

FIG. 3B is a diagram illustrating a framework for replacing a toner cartridge provided in a device. When a toner cartridge is replaced, a user opens the main body cover 701. The position, which can be viewed by opening the main body cover 701, directly under the main body cover 701 is a replacement position 401 at which a toner cartridge can be replaced. A user can replace a toner cartridge located at the replacement position 401. Note that the replacement position 401 of the toner cartridge is not limited to the position shown in FIG. 3B, but may differ depending on the construction of the device 103.

The toner cartridge 730C is the cyan toner cartridge. The toner cartridge 730M is the magenta toner cartridge. The toner cartridge 730Y is the yellow cartridge. The toner cartridge 730Bk is the black toner cartridge. In the example shown in FIG. 3B, the toner cartridge 730Bk is replaceable.

Each of the toner cartridge 730C, 730M, 730Y, and 730Bk is mounted on the developing unit 726 that rotates about the shaft P. When the device 103 receives a replacement position movement instruction from the controller unit 313, the device 103 rotates the developing unit 726, and moves the specified toner cartridge to the replacement position.

Figure 4A:
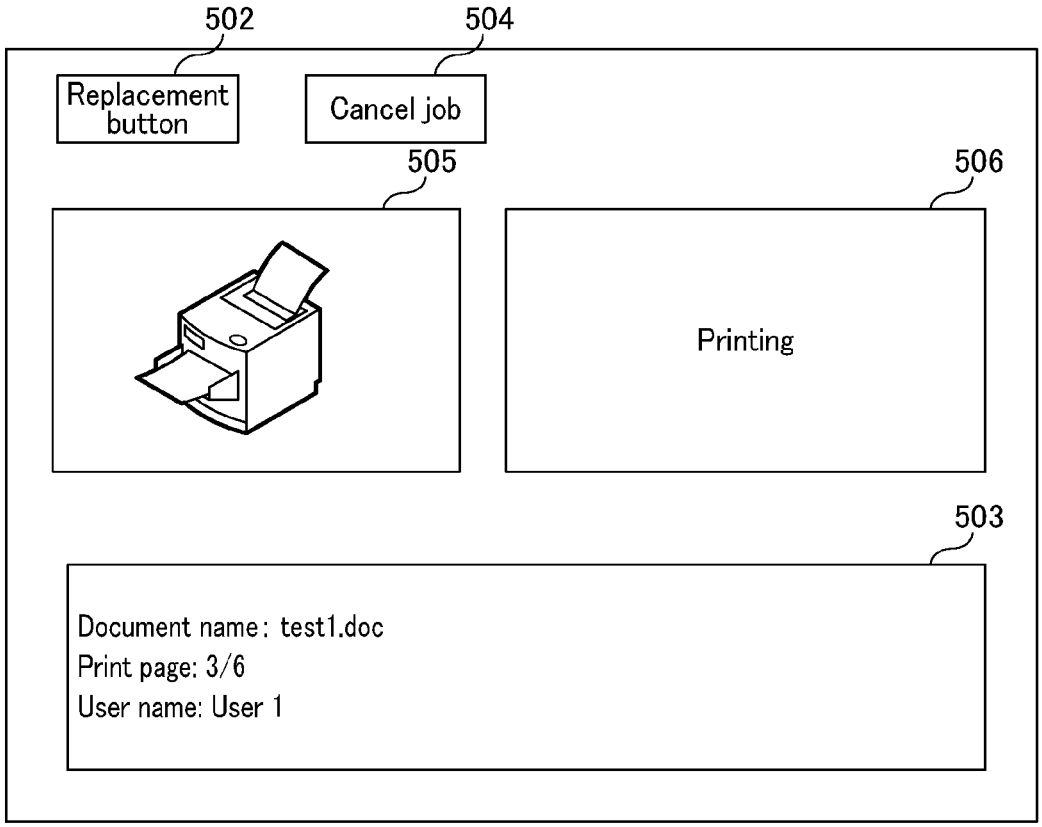
FIG. 4A is a diagram illustrating an example of a screen to be displayed by a UI application installed on a PC.
Figure 4B:
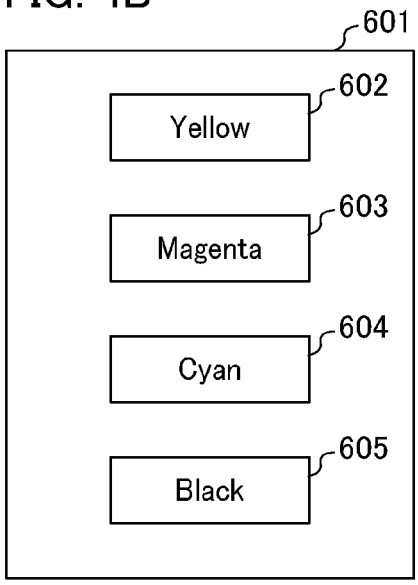
FIG. 4B is a diagram illustrating an example of a replacement dialogue.
Figure 4C:
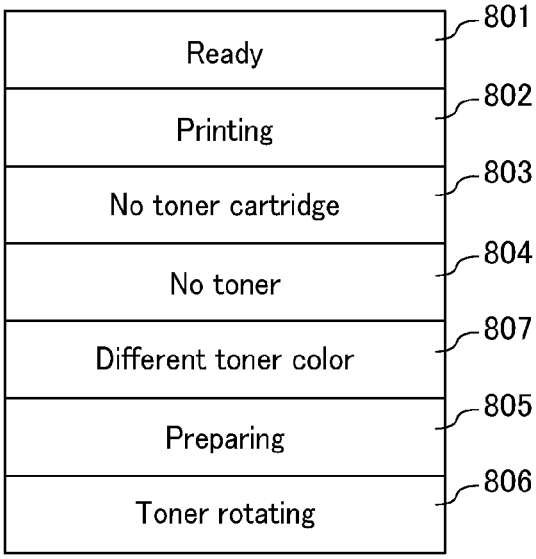
FIG. 4C is a list of all possible statuses of a device.

FIGS. 4A to 4C are diagrams illustrating examples of a screen to be displayed on a PC. FIG. 4A is a diagram illustrating an example of a screen to be displayed by a UI application installed on the PC 102. The CPU 201 of the PC 102 executes a UI application. The UI application is connected to the device 103 via the USB I/F 208 or the LAN I/F 207. When the PC 102 installs the UI application in response to the operation of the user 101, the UI application is associated with the device 103.

A device state display unit 505 in the screen shown in FIG. 4A displays the status (state) of the device 103 that is connected to the UI application. With this arrangement, the status of the device 103 is reported to a user of the PC 102. In this example, the device state display unit 505 displays an image indicating that the device 103 is in the state of printing (printing state). A device state description unit 506 displays a text indicating the state of the device 103 that is in connection with the UI application. In this example, the device state description unit 506 displays a text indicating that the device 103 is in the printing state.

A job execution state display unit 503 displays information indicating the printing status of a job executed by the device 103 that is in connection with the UI application. In this example, the job execution state display unit 503 displays information indicating that a user of User 1 is printing a job of which the document name is test1.doc and that the printing of three pages out of six pages has been completed. When the device 103 does not perform printing, the job execution state display unit 503 does not display information.

A replacement button 502 is a button that displays the replacement dialogue shown in FIG. 4B. When a user selects the replacement button 502 via the operation unit 206, the replacement dialogue is displayed. A job canceling button 504 is a button that stops a job which is being executed by the device 103. When a user operates the job canceling button 504 via the operation unit 206, a job that is being executed by the device 103 is stopped.

FIG. 4B is a diagram illustrating an example of a replacement dialogue. A replacement dialogue 601 is used for moving any one color toner cartridge among the toner cartridges (730Y, 730M, 730C, 730Bk) of the device 103 to the replacement position 401 by the user 101. The replacement dialogue 601 has a yellow selection button 602, a magenta selection button 603, a cyan selection button 604, and a black selection button 605.

When the user 101 selects the yellow selection button 602, the UI application provides a replacement position movement instruction to the device 103 (the controller unit 313 thereof) via a USB interface 208. The controller unit 313 of the device 103 that has received the replacement position movement instruction moves the yellow toner cartridge (730Y) to the replacement position 401.

FIG. 4C is a list of all possible statuses of a device. The statuses shown in FIG. 4C are displayed on the device state display unit 505 and the device state description unit 506 in the screen shown in FIG. 4B. A "ready" 801 indicates the state in which the device 103 is ready to perform printing. A "printing" 802 indicates the state in which the device 103 is performing a printing operation. A "no toner cartridge" 803 indicates the state in which no one of the toner cartridges (730Y, 730M, 730C, 730Bk) is set on the device (103). A "no toner" 804 indicates the state in which no toner remains in any one of the toner cartridges (730Y, 730M, 730C, and 730Bk).

A "different toner color" 807 indicates the state in which a toner cartridge corresponding to any one of colors (730Y, 730M, 730C, and 730Bk) is set on an incorrect development sleeve (731Y, 731M, 731C, and 731Bk).

A "preparing" 805 indicates the state in which the device 103 is preparing for transition to a printable state. A "toner rotating" 806 is the in-motion status described above, and corresponds to the state in which the device 103 is performing an operation for rotating any one of the toner cartridges (730Y, 730M, 730C, and 730Bk) to the replacement position. The printer unit 314 provided in the device 103 acquires the respective statuses, and the controller unit 313 receives the status acquired by the printer unit 314 from the printer unit 314 to thereby detect the status of the device 103. The controller unit 313 reports the detected status to the UI application via a USB I/F 306 or a LAN I/F 311. Then, the UI application displays the reported status on a screen.

Among the statuses shown in FIG. 4C, a plurality of statuses may occur in a simultaneous manner. In this case, the controller unit 313 selects the status having the highest priority from the statuses that are being detected, and reports it to the UI application. The priority of the statuses is determined in advance. For example, the priority is given in the order of the "toner rotating" 806, the "preparing" 805, the "no toner" 804, the "no toner cartridge" 803, the "printing" 802, and the "ready" 801. When the controller unit 313 detects the "toner rotating" 806, the controller unit 313 reports the status to be displayed, which has been selected by the processing flow (to be described below) with reference to FIG. 6, to the UI application.

Figure 5:
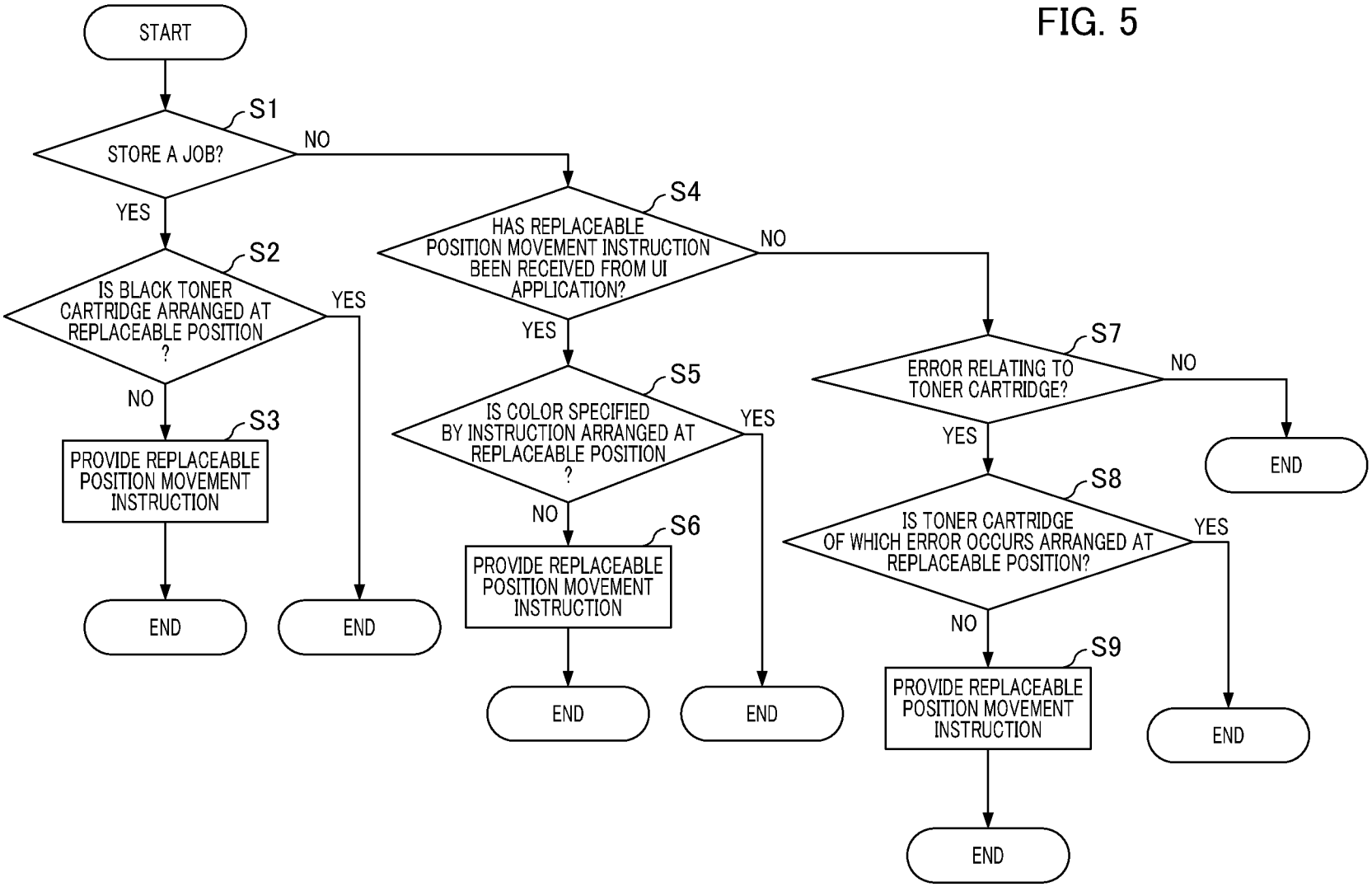
FIG. 5 is a flowchart illustrating replacement position movement instruction processing.

FIG. 5 is a flowchart illustrating replacement position movement instruction processing performed by a controller unit. The CPU 301 provided in the controller unit 313 determines whether or not a replacement position movement instruction is provided to the printer unit 314 in accordance with the flowchart shown in FIG. 5 at a regular interval.

Firstly, the controller unit 313 determines whether or not the controller unit 313 itself stores a job (e.g., print job) (step S1). When the controller unit 313 stores a job, the controller unit 313 makes an inquiry about whether or not a toner cartridge that is arranged at the replacement position 401 is a black toner cartridge (730Bk) to the printer unit 314 (step S2). Then, based on the response from the printer unit 314 that has responded to the inquiry, the controller unit 313 determines whether or not a toner cartridge that is arranged at the replacement position 401 is a black toner cartridge (730Bk). When a toner cartridge that is arranged at the replacement position 401 is a black toner cartridge (730Bk), the process is ended. On the other hand, when a toner cartridge that is arranged at the replacement position 401 is not a black toner cartridge (730Bk), the controller unit 313 provides a replacement position movement instruction to the printer unit 314, and moves the black toner cartridge to the replacement position (step S3).

When the controller unit 313 is not holding a job, the controller unit 313 determines whether or not a replacement position movement instruction has received from the UI application (step S4). When the controller unit 313 has received the replacement position movement instruction from the UI application, the controller unit 313 makes an inquiry about whether or not a toner cartridge that corresponds to the color specified by the replacement position movement instruction is arranged at the replacement position 401 to the printer unit 314 (step S5). Based on the response from the printer unit 314 that has responded to the inquiry, the controller unit 313 determines whether or not a toner cartridge storing therein the color toners specified by the replacement position movement instruction is arranged at the replacement position 401.

When a toner cartridge storing therein the color toners specified by the replacement position movement instruction is arranged at the replacement position 401, the process is ended. On the other hand, when a toner cartridge storing therein the color toners specified by the replacement position movement instruction is not arranged at the replacement position 401, the controller unit 313 performs the following processing. The controller unit 313 provides a replacement position movement instruction to the printer unit 314, and moves the toner cartridge to the replacement position (step S6).

When the controller unit 313 has not received the replacement position movement instruction from the UI application, the controller unit 313 performs the following processing. The controller unit 313 determines whether or not an error relating to a toner cartridge occurs (step S7). In this example, the controller unit 313 determines whether or not an error such as "no toner cartridge", "different toner color", or "no toner" occurs.

When an error relating to a toner cartridge does not occur, the process is ended. On the other hand, when an error relating to a toner cartridge occurs, the controller unit 313 makes an inquiry about whether or not a toner cartridge of which an error occurs is arranged at the replacement position to the printer unit 314 (step S8). Based on the response from the printer unit 314 that has responded to the inquiry, the controller unit 313 determines whether or not a toner cartridge for which an error has occurred is arranged at the replacement position (step S8). When a toner cartridge for which an error has occurred is arranged at the replacement position, the process is ended. On the other hand, when a toner cartridge for which an error has occurred is not arranged at the replacement position, the controller unit 313 performs the following processing. The controller unit 313 provides a replacement position movement instruction to the printer unit 314, and moves a toner cartridge for which an error has occurred to the replacement position (step S9).

The replacement position movement instruction in step S6 is a replacement position movement instruction provided by the operation input of the user 101 using the replacement dialogue. More specifically, the replacement position movement instruction is provided based on the intention of the user 101. On the other hand, the replacement position movement instruction in step S3 or step S9 is an instruction that is automatically executed by the controller unit 313 regardless of the intention of the user 101. If the UI application displays the state of the device 103, i.e., "toner rotating", which is provided by the replacement position movement instruction to be automatically executed, on the device state display unit 505 and the device state description unit 506 in the screen shown in FIG. 4A, the user 101 may be confused. Thus, the controller unit 313 executes processing to be described with reference to FIG. 6, and reports the state "toner rotating" to the UI application only at the timing at which "toner rotating" is to be displayed on the UI application.

Figure 6:
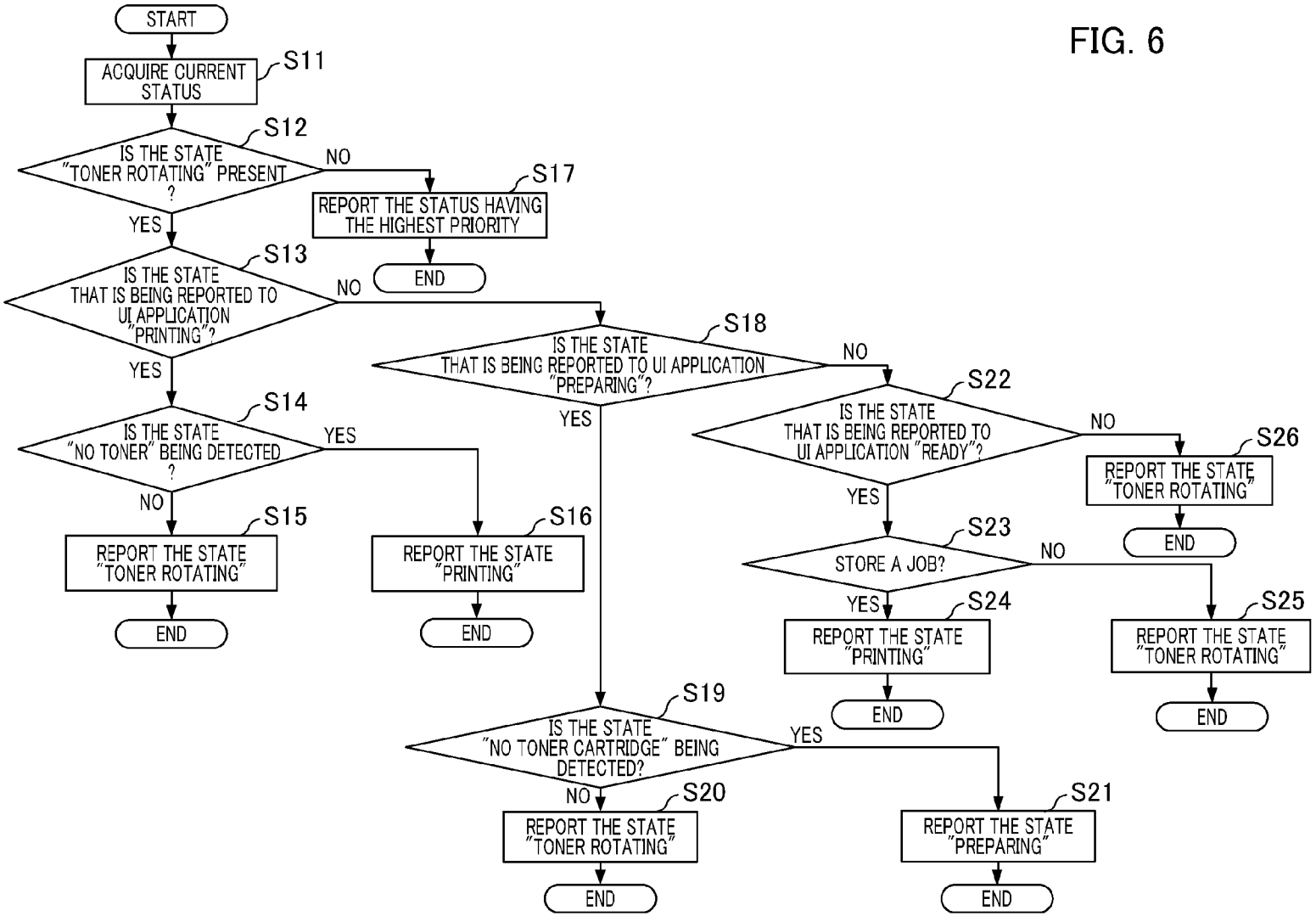
FIG. 6 is a flowchart illustrating device state report processing.

FIG. 6 is a flowchart illustrating processing for reporting the state of the device from the controller unit to the UI application. The CPU 301 provided in the controller unit 313 performs processing in accordance with the flowchart shown in FIG. 6 at a regular interval, and determines the state of the device 103, which will be displayed on the UI application.

Firstly, the controller unit 313 makes an inquiry about the current status of the device 103 (the printer unit 314 thereof) to the printer unit 314 via the printer I/F 310, and acquires the current status (step S11). Next, the controller unit 313 determines whether or not the state "toner rotating", that is, the in-motion status, is included in the acquired statuses (step S12). When the state "toner rotating" is not included among the acquired statuses, the controller unit 313 reports the status having the highest priority among the acquired statuses as the subject to be displayed to the UI application (step S17).

When the state "toner rotating" is included in the acquired statuses, the controller unit 313 determines whether or not the state that is currently being reported to the UI application by the controller unit 313 is "printing" (step S13). When the state that is currently being reported to the UI application by the controller unit 313 is "printing", the controller unit 313 determines whether or not the state "no toner" is being detected by itself (step S14). When the state "no toner" is not being detected, the controller unit 313 determines that the state "toner rotating", which is currently being detected, is the state that is caused by a replacement position movement instruction provided by the operation input of the user 101 using the replacement dialogue, that is, the state that is to be displayed. Thus, the controller unit 313 reports the state "toner rotating" as the subject to be displayed to the UI application (step S15).

When the state "no toner" is being detected, the controller unit 313 determines that the state "toner rotating", which is currently being detected, is not the state that is caused by a replacement position movement instruction provided by the operation input of the user 101. Then, the controller unit 313 determines that the state "toner rotating" is not the state to be displayed. More specifically, when the in-motion status is not the state corresponding to the movement of the toner cartridge in response to the user operation input, the controller unit 313 determines that the in-motion status should not be reported to a user. Next, the controller unit 313 refers to the alternative state table shown in, for example, FIG. 7, and determines the state to be reported as the subject to be displayed to the UI application.

The alternative state table shown in FIG. 7 has alternative state information that is the correspondence information between the state upon rotation detection, the transition state after rotation, and the report state. The state upon rotation detection is the status that is being reported to the UI application by the controller unit 313 upon detection of the state "toner rotating", that is, the state of a device that is currently being displayed on the display unit of the PC 102 (first state). The transition state after rotation is the status of the device 103 that transits after the rotation-moving toner cartridge has moved to the replacement position, that is, the second state as described above. When the states of "toner rotating" and "no toner" are being detected by the controller unit 313, the transition state after rotation is "no toner". When the states of "toner rotating" and "different toner color" are being detected by the controller unit 313, the transition state after rotation is "different toner color". When the states of "toner rotating" and "no toner cartridge" are being detected by the controller unit 313, the transition state after rotation is "no toner cartridge". Also, when the state upon rotation detection is "ready" and the controller unit 313 detects that the controller unit 313 itself has a job, the transition state after rotation is "printing". The report state is the state that is reported as the subject to be displayed to the UI application by the controller unit 313. The alternative state table is stored in the Flash ROM 302 in advance.

As described above, in step S13 shown in FIG. 6, the state that is currently being reported to the UI application by the controller unit 313 (the state upon rotation detection) is "printing". Also, in step S14 shown in FIG. 6, the controller unit 313 detects the state "no toner". More specifically, the transition state after rotation is "no toner". Thus, the controller unit 313 refers to the first entry (first row data) in the alternative state table shown in FIG. 7, and selects "printing" that is set in the report state included in the entry. The selected state "printing" is the same state as that set in the state upon rotation detection included in the entry. The controller unit 313 determines the selected state "printing" as the state substituting "toner rotating".

Referring back to FIG. 6, the controller unit 313 reports the state "printing", which has determined as the status for substitution, as the status to be displayed to the UI application (step S16).

When the state that is currently being reported to the UI application by the controller unit 313 is not "printing", the controller unit 313 determines whether or not the state that is currently being reported to the UI application is "preparing" (step S18). When the state that is currently being reported to the UI application is "preparing", the controller unit 313 determines whether or not the state "no toner cartridge" is being detected (step S19). When the state "no toner cartridge" is being detected, the controller unit 313 determines that the state "toner rotating", which is currently being detected, is the state that is caused by a replacement position movement instruction provided by the operation input of the user 101 using the replacement dialogue, that is, the state that is to be displayed. Thus, the controller unit 313 reports the state "toner rotating" as the subject to be displayed to the UI application (step S20).

When the state "no toner cartridge" is being detected, the controller unit 313 determines that the state "toner rotating", which is currently being detected, is not the state that is caused by a replacement position movement instruction provided by the operation input of the user 101. More specifically, the controller unit 313 determines that the state "toner rotating" is not the state to be displayed. Next, the controller unit 313 refers to the alternative state table shown in FIG. 7, and determines the state "preparing" as the state substituting "toner rotating". Then, the controller unit 313 reports the state "preparing" as the subject to be displayed to the UI application (step S21).

When the state that is currently being reported to the UI application by the controller unit 313 is not "preparing", the controller unit 313 determines whether or not the state that is currently being reported to the UI application is "ready" (step S22). When the state that is currently being reported to the UI application is "ready", the controller unit 313 determines whether or not the controller unit 313 itself stores a job, that is, the transition state after rotation is "printing" (step S23). When the controller unit 313 is not holding a job, the controller unit 313 determines that the state "toner rotating", which is currently being detected by itself, is the state that is caused by a replacement position movement instruction provided by the operation input of the user 101 using the replacement dialogue, that is, the state that is to be displayed. Thus, the controller unit 313 reports the state "toner rotating" as the subject to be displayed to the UI application (step S25).

When the controller unit 313 stores a job, the controller unit 313 determines that the state "toner rotating", which is currently being detected, is not the state that is caused by a replacement position movement instruction provided by the operation input of the user 101, that is, the state "toner rotating" is not the state to be displayed. Next, the controller unit 313 refers to the alternative state table shown in FIG. 7, and determines the state substituting "toner rotating". More specifically, the controller unit 313 selects "printing" that is set in the report state included in the fourth entry in the alternative state table. The selected state "printing" is the same state as that set in the state upon rotation detection included in the entry. The controller unit 313 determines the selected state "printing" as the state substituting "toner rotating". Then, the controller unit 313 reports the state "printing" as the subject to be displayed to the UI application (step S24).

According to the processing for reporting the state of the device from the controller unit to the UI application described with reference to FIGS. 6 and 7, the controller unit 313 does not report the state "toner rotating" to the UI application when the state "toner rotating" should not be displayed. In this case, the controller unit 313 determines an appropriate status substituting "toner rotating", and reports it to the UI application. More specifically, according to the image forming apparatus of the present embodiment, an appropriate status substituting "toner rotating", which will be determined depending on the state upon rotation detection and the transition state after rotation, may be displayed on the PC 102. Consequently, even when the controller unit 313 automatically provides a replacement position movement instruction, the controller unit 313 can report the appropriate status corresponding to the state of the device 103 to the user 101 of the PC 102.

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-135734 filed Jun. 15, 2010, which is hereby incorporated by reference herein in its entirety.

What is claimed is:

1. An image forming apparatus that rotationally moves a plurality of recording material storage units that store a recording material to thereby perform a printing, the image forming apparatus comprising:

a moving unit configured to move the recording material storage unit to a replacement position;

a detection unit configured to detect an in-motion status in which the recording material storage unit is moving to the replacement position; and a determination unit configured to determine either a first state or a second state of the image forming apparatus as the state of the image forming apparatus that is to replace the in-motion status and should be reported to a user when the detection unit detects the in-motion status should not be reported to a user, wherein the first state is a state which is currently being reported to the user when it is detected that the recording material storage unit is in the in-motion status, and wherein the second state is a state which transitions after the recording material storage unit moves to the replacement position, and the second state is a printing state in which the image forming apparatus is in printing.

2. The image forming apparatus according to claim 1, wherein, among the plurality of recording material storage units, only one recording material storage unit at the replacement position is replaceable, the moving unit moves the recording material storage unit to the replacement position depending on a user operation input or the state of the image forming apparatus, and the determination unit determines that the in-motion status should not be reported to a user, when the in-motion status is not the state corresponding to the movement of the recording material storage unit in response to the user operation input.

3. The image forming apparatus according to claim 1, further comprising a display unit to display the state of the image forming apparatus, with the display unit being an external device that communicates via a network.

4. An image forming apparatus that rotationally moves a plurality of recording material storage units that store a recording material to thereby perform a printing, the image forming apparatus comprising:

a moving unit configured to move the recording material storage unit to a replacement position;

a detection unit configured to detect an in-motion status in which the recording material storage unit is moving to the replacement position; and a determination unit configured to determine either a first state or a second state of the image forming apparatus as the state of the image forming apparatus that is to replace the in-motion status and should be reported to a user when the detection unit detects the in-motion status is not the state corresponding to the movement of the recording material storage unit in response to the user operation input and it is determined that the detected in-motion status should not be reported to a user, wherein the first state is a state which is currently being reported to the user when it is detected that the recording material storage unit is in the in-motion status, and wherein the second state is a state which transitions after the recording material storage unit moves to the replacement position, and the second state is a printing state in which the image forming apparatus is in printing.

5. A method for controlling an image forming apparatus that rotationally moves a plurality of recording material storage units that store a recording material to thereby perform a printing, the method comprising:

detecting an in-motion status in which the recording material storage unit is moving to replacement position; and determining either a first state or a second state as the state of the image forming apparatus that is to replace the in-motion status and should be reported to a user when the detection unit detects the in-motion status should not be reported to a user, wherein the first state is a state which is currently being reported to the user when it is detected that the recording material storage unit is in the in-motion status, and wherein the second state is a state which transitions after the recording material storage unit moves to the replacement position, and the second state is a printing state in which the image forming apparatus is in printing.

6. A method for controlling an image forming apparatus that rotationally moves a plurality of recording material storage units that store a recording material to thereby perform a printing, the method comprising:

detecting an in-motion status in which the recording material storage unit is moving to the replacement position; and determining either a first state or a second state of the image forming apparatus as the state of the image forming apparatus that is to replace the in-motion status and should be reported to a user when the detection unit detects the in-motion status is not the state corresponding to the movement of the recording material storage unit in response to the user operation input and it is determined that the detected in-motion status should not be reported to a user, wherein the first state is a state which is currently being reported to the user when it is detected that the recording material storage unit is in the in-motion status, and wherein the second state is a state which transitions after the recording material storage unit moves to the replacement position, and the second state is a printing state in which the image forming apparatus is in printing.

7. A non-transitory computer readable storage medium on which is stored a computer program for making a computer execute a method for controlling an image forming apparatus that rotationally moves a plurality of recording material storage units that store a recording material to thereby perform a printing, the method comprising:

detecting an in-motion status in which the recording material storage unit is moving to the replacement position; and determining either a first state or a second state of the image forming apparatus as the state of the image forming apparatus that is to replace the in-motion status and should be reported to a user when the detection unit detects the in-motion status is not the state corresponding to the movement of the recording material storage unit in response to the user operation input and it is determined that the detected in-motion status should not be reported to a user, wherein the first state is a state which is currently being reported to the user when it is detected that the recording material storage unit is in the in-motion status, and wherein the second state is a state which transitions after the recording material storage unit moves to the replacement position, and the second state is a printing state in which the image forming apparatus is in printing.

* * * * *